United States Patent [19]

Takahashi et al.

[11] Patent Number: 4,799,418

[45] Date of Patent: Jan. 24, 1989

[54] VACUUM ACTUATOR FOR VEHICLE SPEED CONTROL

[75] Inventors: Yoshikazu Takahashi; Toshio Nishiyama, both of Kiryu, Japan

[73] Assignee: Mitsuba Electric Mfg. Co., Ltd., Gunma, Japan

[21] Appl. No.: 87,704

[22] Filed: Aug. 21, 1987

[51] Int. Cl.[4] ..... F15B 11/08

[52] U.S. Cl. ..... 91/449; 91/454; 91/459; 137/315; 137/454.6; 180/175; 439/64; 439/377

[58] Field of Search ..... 91/418, 443, 449, 454, 91/457, 459; 180/175, 176, 177; 137/315, 454.6, 15; 251/367, 129.15; 439/64, 76, 716, 377, 378, 374

[56] References Cited

U.S. PATENT DOCUMENTS

| | | | |
|---|---|---|---|
| 3,758,716 | 9/1973 | James et al. | 439/64 X |
| 4,158,192 | 6/1979 | Muta | 180/177 X |
| 4,346,775 | 8/1982 | Treadwell | 180/175 |
| 4,431,077 | 2/1984 | Burney | 180/176 |
| 4,464,832 | 8/1984 | Asick et al. | 439/76 X |
| 4,543,983 | 10/1985 | Pauliukonis | 137/550 X |
| 4,697,478 | 10/1987 | Mastumoto et al. | 180/177 X |
| 4,710,136 | 12/1987 | Suzuki | 439/374 |

*Primary Examiner*—Edward K. Look
*Attorney, Agent, or Firm*—Marshall & Melhorn

[57] ABSTRACT

Disclosed is a pressure actuator such as a vacuum actuator comprising a valve unit including a plurality of solenoid valves and a diaphragm unit including a diaphragm defining a pressure chamber, air pressure within the pressure chamber being adjusted by selective activation of the solenoid valves which communicate the pressure chamber with pressure sources of different pressure levels, in which a casing of the actuator defines an accommodating chamber for accommodating the solenoid valve unit and a wall surface of the chamber is provided with ribs for guiding and positioning the solenoid valve unit inside the chamber. The ribs may be adapted to make a sliding contact with a side surface of the yokes of the solenoid valves and a smooth surface a printed circuit board which is attached to the solenoid valve unit. Alternatively or additionally, the ribs may be adapted to be fitted into a gap between a pair of adjacent yokes of the solenoid valves. These ribs facilitate the assembly of the solenoid valve unit into the casing, assure the mechanical stability of the actuator and remove the possibility of creating particles as a result of abrasion between the solenoid valve unit and the casing at the time of assembly.

4 Claims, 4 Drawing Sheets

VACUUM ACTUATOR FOR VEHICLE SPEED CONTROL

TECHNICAL FIELD

The present invention relates to a pressure actuator which derives power from a difference of pressure between two pressure sources such as an engine intake system and the atmosphere and in particular to a vacuum actuator for vehicle speed control which is economical and reliable. Typically. one of the pressure sources is the atmosphere but the other pressure source may be either a negative pressure source such as an engine intake system or a positive pressure source derived from an air pump or the like (for instance in the case of a supercharged engine from which negative pressure is not always available).

BACKGROUND OF THE INVENTION

From the past, various speed control devices for maintaining vehicle speed at fixed levels have been known. According to such a speed control device which is sometimes called as a cruise control device, the driver is not required to keep stepping on the accelerator pedal to keep the automobile cruising at a constant speed and he is free from the need for adjusting the depression of the accelerator pedal in order to maintain a constant speed irrespective of the inclination and other conditions of the road.

Vacuum actuators which derive power from negative pressure of the engine intake system are commonly used as actuators for vehicle speed control. A conventional typical vacuum actuator comprises a diaphragm which defines a negative pressure chamber in cooperation with the casing of the actuator and a plurality of solenoid valves which selectively communicate the negative pressure chamber with the intake system of the engine or the atmosphere as required, and the resulting displacement of the diaphragm is transmitted to the accelerator pedal by way of a control cable. The solenoid valves are controlled by a control device incorporating a micro processor, and the output of a speed sensor is supplied to the control device. Thus, using the vehicle speed as a controlled variable and the accelerator pedal depression as a manipulated variable, the control device controls the accelerator pedal depression by way of the solenoid valves and maintains the vehicle speed at a constant level by a feedback control.

Specifically, negative pressure from the engine intake system is supplied to the negative pressure chamber by wa of a negative pressure valve when the accelerator pedal depression is required to be increased, and the atmospheric pressure is introduced into the negative pressure chamber by way of a vent valve when the accelerator pedal depression is required to be reduced. Additionally, when the accelerator pedal is required to be quickly released, for instance when the vehicle brake is activate, a safety valve is activated and quickly communicates the negative pressure chamber with the atmosphere. Thus, in order to assure a high level of reliability, the vent valve and the safety valve are used in parallel in a redundant manner. Japanese Patent Laid-Open Publication No. 62-96144 (based on US patent applicatoin No. 783,039 filed on Sept. 30, 1985) discloses a vacuum actuator of this type.

In assembling this vacuum actuator, the three solenoid valves are required to be fitted into the casing of the actuator while maintaining necessary sealing requirements. Typically, because such a vacuum actuator is required to be installed in a very limited space in an engine room of an automobile and is therefore required to be highly compact, a considerable difficulty arises when assembling the actuator. For instance, because it is desirable to provide the casing of the actuator with a means or surfaces for supporting the solenoid valve assembly for the purpose of assuring the necessary mechanical stability of the system and eliminating any wasted space within the casing, when solenoid valves are installed into the casing of the actuator, the rugged corners of the solenoid valve assembly may scrape off chips from the casing which is typically made of synthetic resin and thse chips could cause a failure of the actuator by impairing the proper functioning of the solenoid valves.

BRIEF SUMMARY OF THE PRESENT INVENTION

In view of such a recognition of the inventors and the problems of the prior art, a primary object of the present invention is to provide a compact vacuum actuator which is suitable for use as an actuator for a vehicle speed control system.

Another object of the present invention is to provide a vacuum actuator which is compact and is yet free from problems when being assembled.

Yet another object of the present invention is to provide a vacuum actuator which is compact and is yet highly reliable.

According to the present invention, these and other objects of the present invention can be accomplished by providing a pressure actuator comprising a solenvoid valve unit including a plurality of solenoid valves and a diaphragm unit including a diaphragm defining a pressure chamber, air pressure within the pressure chamber being adjusted by selective activation of the solenoid valves which communicate the pressure chamber with pressure sources of different pressure levels, wherein: a casing of the actuator defines an accommodating chamber for accommodating the solenoid valve unit and a wall surface of the chamber is provided with a rib for guiding and positioning the solenoid valve unit inside the accommodating chamber.

According to a certain aspect of the present invention, the rib extends along a direction in which the solenoid valve unit is fitted into the accommodating chamber so as to make a sliding contact with a side surface of a yoke of one of the solenoid valves and/or a smooth surface of a printed circuit board which is attached to the solenoid valve unit.

This rib facilitates the assembly of the solenoid valve unit into the casing, assures the mechanical stability of the actuator and removes the possibility of creating particles as a result of abrasion between the solenoid valve unit and the casing at the time of assembly.

According to another aspect of the present invention, the rib is provided in a bottom wall of the accommodating chamber and is adapted to be fitted into a gap between a pair of adjacent yokes of the solenoid valves. This features assures the mechanical stability of the solenoid valve unit even when the rigidity of the solenoid valve unit 1 by itself may be lacking.

According to yet another aspect of the present invention, a front end of the solenoid valve unit is provided with a port member which is adapted to be fitted into a hole provided in a bottom wall of the chamber by way of a seal means and the fitting of the port member with the hole is facilitated by provision of a tapering surface provided in either the port member or the hole. When this feature is combined with the above mentioned features, the air tight coupling between the port member and the hole can be accomplished in a reliable manner.

DETAILED DESCRIPTION OF THE PREFERRED EMBODIMENT

Now the present invention is described in the following with reference to the appended drawings.

Figure 1:
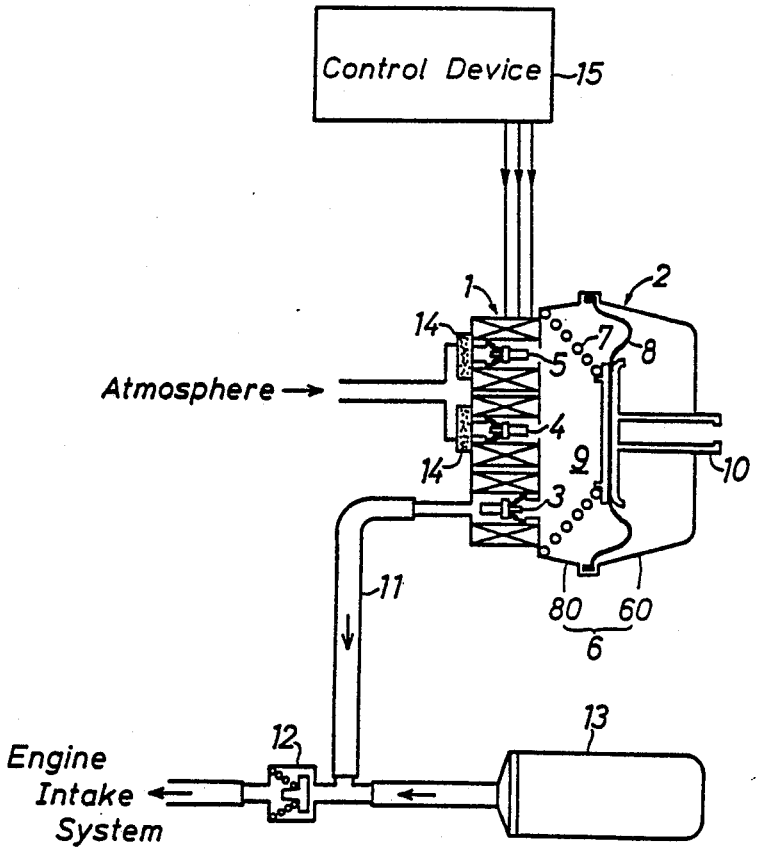
FIG. 1 is a schematic view illustrating the overall structure and the action of the cruise control device to which the vacuum actuator of the present invention is applied.

FIG. 1 shows a preferred embodiment of the vacuum actuator according to the present invention, and this vacuum actuator comprises a solenvoid valve unit 1 and a diaphragm unit 2. The overall housing 6 of this vacuum actuator comprises a casing 80 which is made of synthetic resin material and accommodates the solenoid valve unit 1 and another casing 60 which is made of sheet metal and accommodates diaphragm unit 2. The solenoid valve unit 1 comprises a vacuum valve 3, a safety valve 4 and a vent valve 5.

Figure 4:
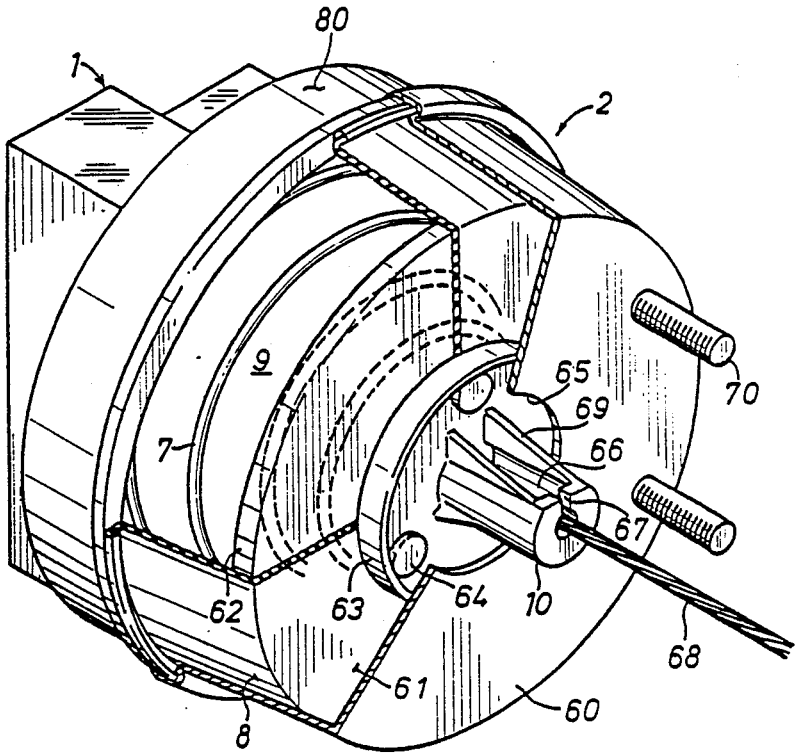
FIG. 4 is a partly broken-away perspective view of the vacuum actuator.

As best shown in FIG. 4, a diaphragm 8 which is biased by a conical coil spring 7 is interposed between the two parts of the housing 6 and defines a vacuum chamber 9 in cooperation with the casing 80 of the solenoid valve unit 1. A wire holder 10 is attached to a central part of the diaphragm 8 so as to project out of the casing 60 of the diaphragm unit 2. Thus, dependent upon the magnitude of the negative pressure in the negative pressure chamber 9, the wire holder 10 is axially displaced and actuates a accelerator pedal (not shown in the drawings) by way of a control cable as described in greater detail hereinafter.

A first port of the vacuum valve 3 is connected to an engine intake system (not shown in the drawings) by way of a conduit 11 and a check valve 12 while a second port of the vacuum valve 3 is communicated with the vacuum chamber 9 within the casing 80 as described hereinafter. The conduit 11 is also connected to an accumulator 13 for storing vacuum or negative pressure therein. Thus, by opening this vacuum valve 3, the negative pressure in the negative pressure chamber 9 is increased and the diaphragm 8 is pulled inwardly against the spring force of the conical coil spring 7 thereby actuating the accelerator pedal in the direction to increase the vehicle speed.

A first port of the vent valve 4 is connected to the atmosphere by way of an air filter unit 14 while a second port of the vent valve 4 is likewise communicated with the vacuum chamber 9 within the casing 80. Therefore, by opening the vent valve 4, the negative pressure in the negative pressure chamber 9 is reduced by the introduction of atmospheric air into the negative pressure chamber 9 and the diaphragm 8 is pushed outwardly by the conical coil spring 7 thereby actuating the accelerator pedal in the direction to reduce the vehicle speed.

A first port of the safety valve 5 is communicated with the atmosphere by way of the air filter unit 14 in the same way as the vent valve 4 while a second port of the safety valve 5 is likewise communicated with the vacuum chamber 9 within the casing 80. By opening the safety valve 5, the negative pressure chamber 9 is rapidly communicated with the atmosphere. This safety valve 5 is opened when the action of the cruise control is to be stopped either as a voluntary action of the driver or as an automatic action when the control system has detected a certain condition.

These solenvoid valves 3 to 5 are controlled by signals from the control circuit 15.

Figure 2:
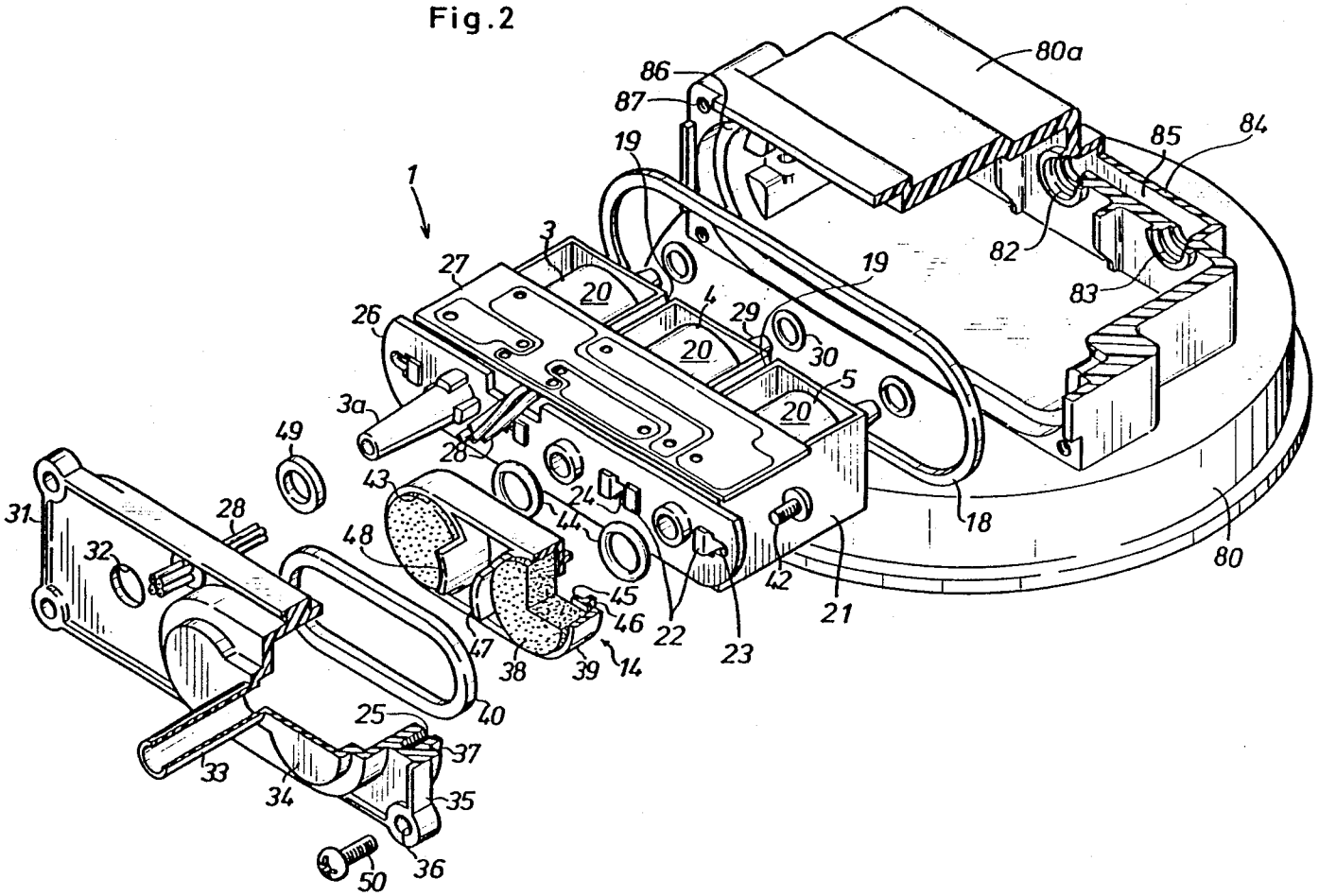
FIG. 2 is an exploded perspective view of the vacuum actuator according to the present invention.

FIG. 2 shows the solenvoid valve unit 1 of the above described actuator unit in greater detail. The casing 80 of the solenoid valve unit 1 is generally dish-shaped and is integrally provided with an extension **80*a* defining an open-ended box. The inner circumference of the open end of the extension 80*a* is provided with a step 86 for supporting a sealing gasket 18 as described hereinafter. Further, the four corners of the open end of the extension 80*a* are each provided with a threaded hole 87**.

The closed end of the extension **80*a* opposite to the open end or the bottom of the extension 80*a* is provided with three holes 81 to 83 for receiving the second ports 29 of the valves 3 to 5 by way of O-rings 30 in an airtight manner. (The hole 81 is shown in FIG. 4.) The hole 81 is individually communicated with the vacuum chamber 9 while the holes 82 and 83 are communicated with the vacuum chamber 9 by way of a common passage 85 defined by a bulge 84 projecting from the bottom wall 80*b* of the extension 80*a***.

Each of the valves 3 to 5 comprises a solenoid 20 and a yoke 21 defining a magnetic circuit outside the solenoid 20 in addition to a valve member, a valve seat and a return spring which are shown only in FIG. 1 in a simplified manner. The yokes 21 are generally C-shaped and their open ends are provided with tongues 22 which are passed through corresponding holes 23 and 24 of a plate 26 and crimped thereto. The plate 26 also serves as a part of the magnetic circuits of the three solenoid valves 3 to 5. As can be seen from FIG. 2, the holes 23 are elongated in shape and additionally receive a pair of small screws 42 which secure the plate 26 to an end cover 31 by being threaded into corresponding threaded holes 25 provided in the end cover 31. The end cover 31 is made of the same material as the casing 80 and defines an enclosed space for accommodating the solenoid valve unit 1 in cooperation with the extension 80a. The holes 24 are also elongated in shape and each receive a pair of tongues 22 belonging to two adjoining yokes 21. These holes 23 and 24 are thus shared either by two tongues or by a tongue and a screw. This not only reduces the work required for punching these holes as compared with the case of providing individual holes for different tongues and screws but also saves space by eliminating the problems involved in forming closely adjoining holes.

The coil wires of these solenoid valves 3 to 5 are connected to a circuit board 27 attached to a broader surface of the solenoid valve unit 1 and are appropriately wired to lead wires 28 which extend to the outside. The other or the first ports **3*a* and 41 of the solenoid valves 3 to 5 project through the plate 26. The first port 3*a* of the vacuum valve 3 is defined by an axially elongated member and is passed through a hole 32 provided in the end cover 31 with an annular seal member 49** made of polymer material fitted over the port member to assure the sealing requirements.

The end cover 31 is further provided with a bulge 34 which accommodates an air filter unit 14. The air filter unit 14 is provided with an air filter holder 39 which is elliptic in shape and accommodates a pair of air filter elements 38. The side of the air filter holder 39 facing the end cover 31 is generally exposed and its outer circumferential edge directed towards the end cover 31 is pressed against the inner surface of the bulge 34 by way of a rubber gasket 40. Vertical walls 47 and 48 are provided in middle parts of the air filter holder 39 facing the end cover 31 so as to control the air flow from an air inlet tube 33 provided integrally with the bulge 34 to the two air filter elements 38. The other side of the air filter holder 39 is provided with a pair of holes 45 which are concentric to the filter elements 38 and are surrounded by concentric annular projections 46 projecting towards the valves 3 to 5. These holes 45 are fitted over the first ports 41 of the vent valve 4 and the safety valve 5 and O-rings 44 fitted inside the annular projections 46 are pressed against the plate 26 around the port 41 and meet the sealing requirements.

Thus, when the small screws 42 are passed through the holes 23 in the plate 26 and threaded into the threaded holes 25 of the end plate 31, the air filter unit 14 is interposed between the plate 26 and the end cover 31.

Figure 3:
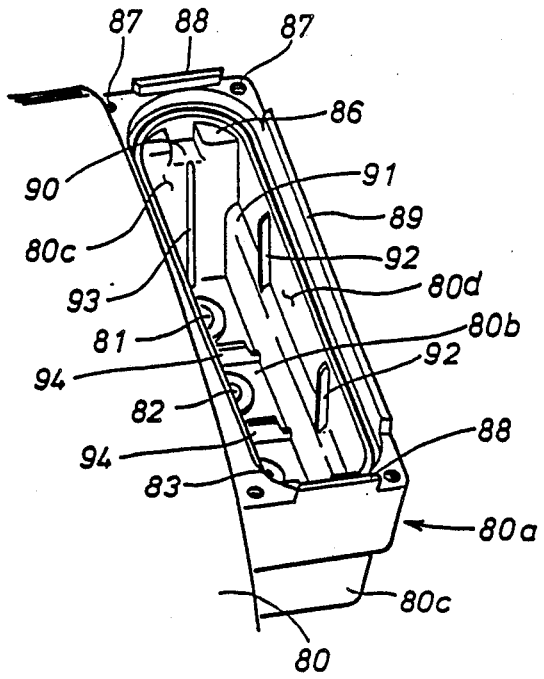
FIG. 3 is a perspective view showing the casing of the vacuum actuator defining a chamber for accommodating a solenoid valve unit.

FIG. 3 shows the interior of the casing extension **80*a*** in greater detail.

The holes 81 to 83 are separated by ribs 94 formed in the bottom wall **80*b*. The extension 80*a* is defined by this bottom wall 80*b*, a pair of end walls 80*c* extending vertically from the main body of the casing 80 and an outer wall 80*d* which extends between the free ends of the bottom wall 80*b* and the end walls 80*c* in parallel with the main body of the casing 80. The inner surface of the outer wall 80*d* is provided with a step 91 which extends laterally along the outer wall 80d thus making the inner part of the extension 80*a* adjacent the bottom wall 80*b* narrower than the outer part of the extension 80*a* adjacent the opening thereof in terms of the distance between the inner surface of the outer wall 80d and the main body of the casing 80. A pair of ribs 92 extend from this step 91 towards the opening of the extension 80*a*. The inner surfaces of the end walls 80*c* are each provided with a step 86 defining a narrower inner part of the extension 80*a* in terms of the distance between the inner surfaces of the two ends walls 80*c*. A depression 90 is provided in each of the steps 86 for avoiding the interference with the head of the corresponding screw 42 which secures the plate 26 to the end cover 31. A rib 93 extends from the bottom wall 80*b* to each of the steps 86 along the inner surface of the corresponding end wall 80*c***.

The open end of the extension **80*a* is provided with ribs 88 and 89 along the edges of the end walls 80*c* and the outer wall 80*d*, respectively, for positioning the end cover 31 by contacting the side edges of the end cover 31 when the valve assembly is fitted into the extension 80*a* and the end cover 31 is placed over the opening of the extension 80*a*. Also, the four corners of the open end of the extension 80*a* are provided with the threaded holes 87 as mentioned earlier. And, the inner surface of the end cover 31 is provided with a shoulder surface 37 which is complementary in shape with the open end of the extension 80*a***.

Thus, when the solenoid valve unit 1 including the end cover 31, the air filter unit 14 and the solenoid valves 3 to 5 is inserted into the extension **80*a* of the casing 80, the valve assembly 1 is guided by the ribs 92 and 93 and the pointed corners of the solenoid valve unit 1 as well as the rugged portions of the printed circuit board 27 are prevented from contacting the inner surface of the extension 80*a*. Since the ribs 92 and 93 contact predetermined definite surface areas the solenoid valve unit 1 which are pre-selected to be smooth, the insertion of the solenoid valve unit 1 into the extension 80*a* can be accomplished in an extremely smooth manner and there is no possibility of scraping off chips from the inner surface of the extension 80*a*. When the solenoid valve unit 1 is completely fitted into the extension, small screws 50 are passed through the holes 36 provided on the four corners of the end cover 31 and threaded into the threaded holes 87 provided in the open end of the extension 80*a***.

As the solenoid valve unit 1 is completely fitted into the extension **80*a*, the ribs 94 provided in the bottom wall 80*b* of the extension are forced into the gaps 19 between the neighboring yokes 21 of the solenoid valve unit 1 and the yokes 21 are thus precisely positioned and held securely at their predetermined positions. Therefore, even when the yokes 21 are not sufficiently rigid by themselves, they are held rigidly and securely once they are assembled into the extension 80*a*. Thus, the thickness of the yokes 21 can be minimized and the weight and the space requirements of the solenoid valve unit 1** can be reduced.

When the solenoid valve unit 1 is completely fitted into the extension **80*a*, small screws 50 are passed through the holes 36 provided on the four corners of the end cover 31 and threaded into the threaded holes 87 provided in the open end of the extension 80*a***.

FIG. 4 shows the diaphragm unit 2 in detail. The casing 60 which is made of sheet metal such as aluminum plate press-formed into a frusto-conical shape and is crimped over the casing 80 of the solenoid valve unit 1 interposing the circumferential fringe of the diaghragm therebetween. The casing 60 is integrally provided with a plurality of stud bolts 70 for mounting the vacuum actuator to an external member. The diaphragm 8 is cup-shaped so as to be substantially complementary to the inner surface of the diaphragm unit casing 60. A flat middle portion 61 of this diaphragm 8 is interposed between a pair of discs 62 and 63 which are securely joined together by rivets 64. The inner disc 62 located inside the vacuum chamber 9 is substantially conformal to the flat middle portion of the diaphragm 8 while the other or the outer disc 63 is slightly greater than a central opening 65 provided in the central part of the diaphragm casing 60. A conical coil spring 7 is interposed between the inner disc 62 and the solenoid valve unit casing 80 and biases the diaphragm 8 in the direction to increase the volume of the vacuum chamber 9. The outer surface of the outer disc 63 is provided with a wire holder 10 consisting of a hollow projection which projects out of the central opening 65 of the diaphragm casing 60. This wire holder 10 is provided with a side slit 66 extending along the whole length thereof, a pair of triangular reinforcement ribs 69 extending between the edges of the slide slit 66 and the outer surface of the outer disc 63, and an inwardly directed flange 67 provided in the free end of the projection and defining a small opening **67*a* in its center. The side slit 66 extends into this small opening 67*a***.

Thus, by passing an end of a control cable 68 provided with a knot consisting of a block attached to the free end thereof into the opening 67*a* by way of the side slit 66, the control cable 68 can be securely connected to the projection 10. The other end of the control cable 68 is connected to an accelerator pedal which is not shown in the drawings.

Thus, according to the present embodiment, the solenvoid valve unit 1 is favourable guided by the ribs 92, 93 and 94 into the accommodating chamber defined in the extension 80*a* and, therefore, the fitting of the port members 29 into the holes 81, 82 and 83 can be accurately accomplished without causing any irregular deformation in the O-rings 30. Furthermore, once the solenoid valve unit 1 is securely fitted into the chamber, it is securely held by the ribs 92, 93 and 94 contacting the valve unit 1 and the mechanical stability of the solenoid valve unit 1 can be assured. In other words, the rigidity of the solenoid valve unit 1 can be safely reduced without any ill effect and, thus, the weight and the size of the solenoid valve unit 1 can be reduced. Additionally, the smooth sliding contact between the ribs 92 and 93 and the solenvoid valve unit 1 eliminates the possibility of any rugged parts of the solenoid valve unit 1 scraping the walls of the chamber and generating small particles which may cause a failure of the solenoid valve unit 1.

Although the present invention has been shown and described with reference to the preferred embodiment thereof, it should not be considered as limited thereby. Various possible modifications and alterations could be conceived of by one skilled in the art to any particular embodiment, without departing from the scope of the invention.

What we claim is:

1. A pressure actuator comprising:

a solenoid valve unit incluidng a plurality of solenoid valves;

a diaphragm unit including a diaphragm defining a pressure chamber, air pressure within the pressure chamber being adjusted by selective activation of the solenoid valves which provide communication between the pressure chamber and pressure sources of different pressure levels;

a casing of the actuator defining an accommodating chamber for accommodating the solenoid valve unit, a wall surface of the accommodating chamber being provided with a rib for guiding and positioning the solenoid valve unit inside the accommodating chamber, the rib being disposed in a bottom wall of the accommodating chamber and adapted to be fitted into a gap between a pair of adjacent yokes of the solenoid valves; and a port member provided in the front end of said solenoid valve unit, said port member adapted to be fitted into a hole provided in the bottom wall of the accommodating chamber of said casing, said hole provided with seal means to effect a seal between said port member and the hole, the fitting of said port member with the hole being facilitated by providing a tapering surface on at least a cooperating surface of said port member or the hole.

2. A pressure actuator as defined in claim 1, wherein the rib extends along a direction in which the solenoid valve unit is fitted into the accommodating chamber.

3. A pressure actuator as defined in claim 2, wherein the rib is adapted to contact a side surface of a yoke of one of the solenoid valves.

4. A pressure actuator as defined in claim 2, wherein the rib is adapted to contact a smooth surface of a printed circuit board which is attached to the solenoid valve unit

* * * * *